US011492790B2

(12) United States Patent
Ukigai et al.

(10) Patent No.: US 11,492,790 B2
(45) Date of Patent: Nov. 8, 2022

(54) FLUSH TOILET DEODORIZING DEVICE

(71) Applicant: TOTO LTD., Kitakyushu (JP)

(72) Inventors: Kiyotake Ukigai, Kitakyushu (JP); Yuya Otowa, Kitakyushu (JP); Shoko Uemoto, Kitakyushu (JP); Shunichi Nakamichi, Kitakyushu (JP); Kanako Isono, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 640 days.

(21) Appl. No.: 16/545,190

(22) Filed: Aug. 20, 2019

(65) Prior Publication Data

US 2020/0063422 A1 Feb. 27, 2020

(30) Foreign Application Priority Data

Aug. 21, 2018 (JP) ..... JP2018-154843
Oct. 18, 2018 (JP) ..... JP2018-196776

(51) Int. Cl.
*E03D 9/00* (2006.01)

(52) U.S. Cl.
CPC ..... *E03D 9/00* (2013.01)

(58) Field of Classification Search
CPC ..... E03D 9/00; E03D 9/052; E03D 9/05
USPC ..... 4/216, 209 R
See application file for complete search history.

(56) References Cited

U.S. PATENT DOCUMENTS 2,859,249 A * 11/1958 Haimsohn ..... C07C 319/24 568/26
4,558,473 A * 12/1985 Morikawa ..... E03D 9/08 4/DIG. 6
5,416,930 A * 5/1995 Waldner ..... E03D 9/052 4/213
5,493,737 A * 2/1996 Chu ..... E03D 9/052 4/213
2006/0064805 A1* 3/2006 Yamamoto ..... E03D 9/05 4/213

FOREIGN PATENT DOCUMENTS

CN 102587476 A 7/2012
JP H03-125732 A 5/1991
JP H07-324365 A 12/1995
JP 2005-155152 A 6/2005
JP 2017-223030 A 12/2017

* cited by examiner

*Primary Examiner* — Christine J Skubinna
(74) *Attorney, Agent, or Firm* — Pearne & Gordon LLP

(57) ABSTRACT

A flush toilet deodorizing device includes an intake port part forming an intake port intaking air; an exhaust port part forming an exhaust port exhausting deodorized air; a fan device provided in a deodorizing air channel, the deodorizing air channel linking the intake port and the exhaust port and allowing air to flow; a water deodorizing part provided in the deodorizing air channel, the water deodorizing part using water to deodorize a suctioned air; and an oxidation catalyst provided in the deodorizing air channel.

7 Claims, 14 Drawing Sheets

FLUSH TOILET DEODORIZING DEVICE

CROSS-REFERENCE TO RELATED APPLICATIONS

This application is based upon and claims the benefit of priority from Japanese Patent Application No. 2018-154843, filed on Aug. 21, 2018 and Japanese Patent Application No. 2018-196776, filed on Oct. 18, 2018; the entire contents of which are incorporated herein by reference.

FIELD

The present invention relates to a flush toilet deodorizing device.

BACKGROUND

As a deodorizing device that deodorizes in a toilet space, a device is known in which offensive-odor components included in air are dissolved in water by causing the air to contact the water (e.g., Japanese Patent Application Publication No. 2017-223030). The deodorizing device according to Japanese Patent Application Publication No. 2017-223030 includes a water spraying device that is provided in a warm-water washing toilet seat and sprays water into suctioned air. The water spraying device includes a water storage part collecting water, and a vibrator disposed at a bottom part of the water storage part. Or, the water spraying device is a nozzle spraying water in a mist-like form.

SUMMARY

Among offensive odors in a toilet space, hydrogen sulfide and methylmercaptan are difficult to dissolve in water compared to ammonia and trimethylamine. Therefore, even if the offensive odors are to be removed from air using only water sprayed by a water spraying device as in Japanese Patent Application Publication No. 2017-223030, hydrogen sulfide and methylmercaptan may not be removed.

A flush toilet deodorizing device according to a first aspect of the invention includes an intake port part forming an intake port intaking air; an exhaust port part forming an exhaust port exhausting deodorized air; a fan device provided in a deodorizing air channel, the deodorizing air channel linking the intake port and the exhaust port and allowing air to flow; a water deodorizing part provided in the deodorizing air channel, the water deodorizing part using water to deodorize a suctioned air; and an oxidation catalyst provided in the deodorizing air channel.

DETAILED DESCRIPTION OF EMBODIMENTS

Figure 1:
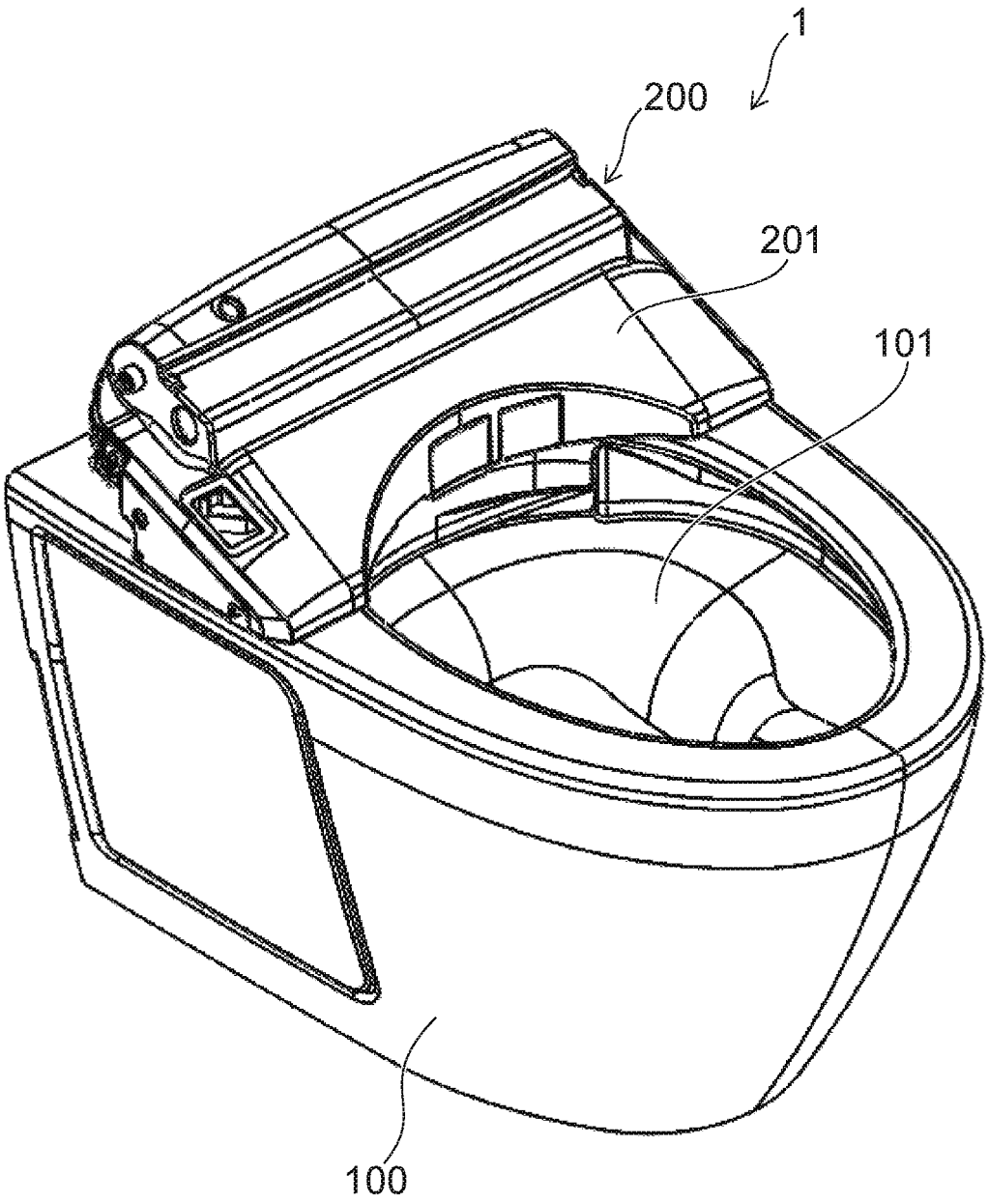
FIG. 1 is an exterior perspective view of a toilet device according to a first embodiment.

One of the embodiments of the invention will now be described with reference to the accompanying drawings. For easier understanding of the description, the same components in the drawings are marked with the same reference numerals when possible; and duplicate descriptions are omitted.

FIG. 1 is an exterior perspective view of a toilet device 1 according to one embodiment.

As shown in FIG. 1, the toilet device 1 that is mounted in a toilet space includes a sit-down flush toilet (hereinbelow, called simply the toilet) 100, and a sanitary washing device 200 mounted on the toilet 100. The toilet 100 includes a bowl part 101 open upward in which water stores. By a user operating an operation part (not illustrated), the bowl part 101 is washed by washing water and drains the washing water through a drainage pipe (not illustrated). The sanitary washing device 200 includes a private part washing functional part that washes a private part such as the bottom or the like of the user sitting on the toilet 100 with a toilet seat (not illustrated) interposed, etc. The sanitary washing device 200 also includes a toilet space deodorizing device (hereinbelow, called simply the deodorizing device) 10.

Figure 2:
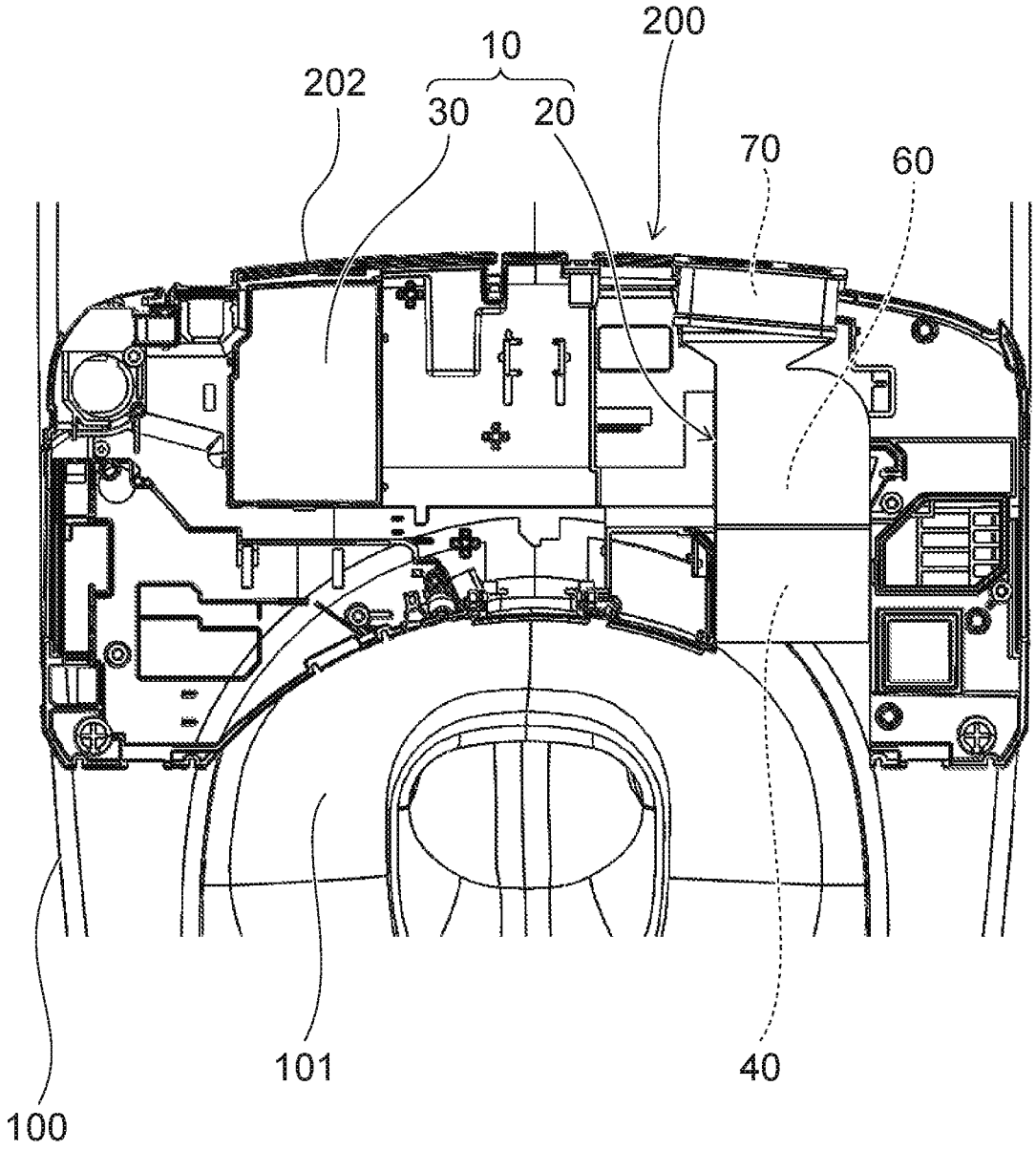
FIG. 2 is a plan view of a flush toilet deodorizing device according to the first embodiment.

FIG. 2 is a plan view of the deodorizing device 10 according to the embodiment, and illustrates a state in which a cover 201 of the sanitary washing device 200 of FIG. 1 is removed. The nozzle and the like that are included in the private part washing functional part are not illustrated in FIG. 2.

As shown in FIG. 2, the deodorizing device 10 includes a water deodorizing unit 20 and a controller 30.

Figure 3:
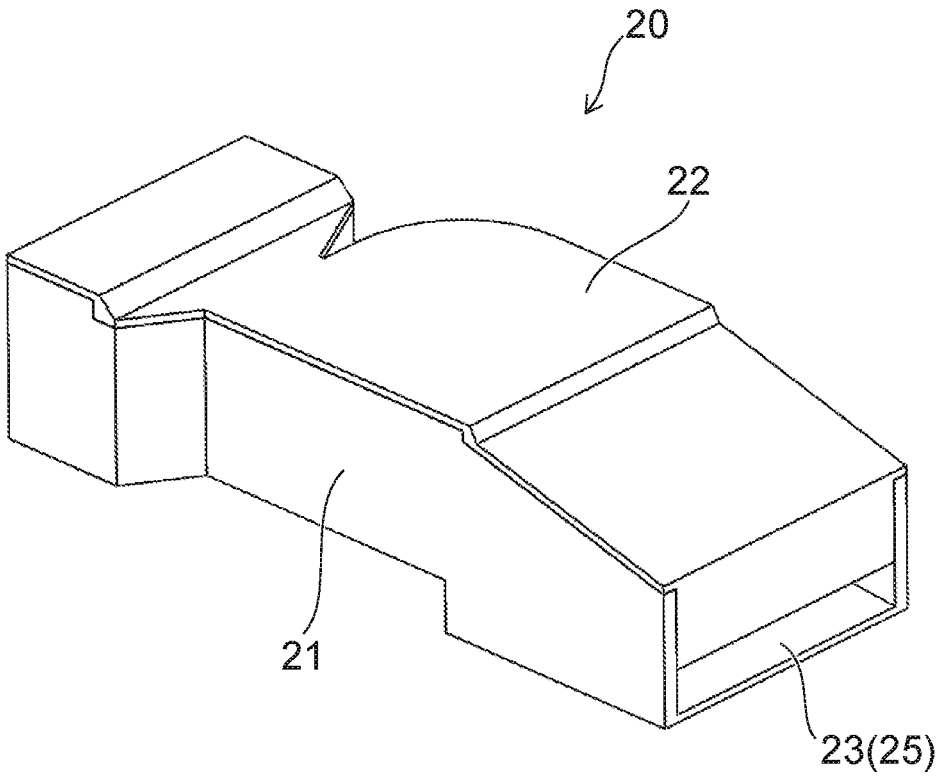
FIG. 3 is a perspective view of a water deodorizing unit of the flush toilet deodorizing device according to the first embodiment.

FIG. 3 is a perspective view of the water deodorizing unit 20.

Figure 4:
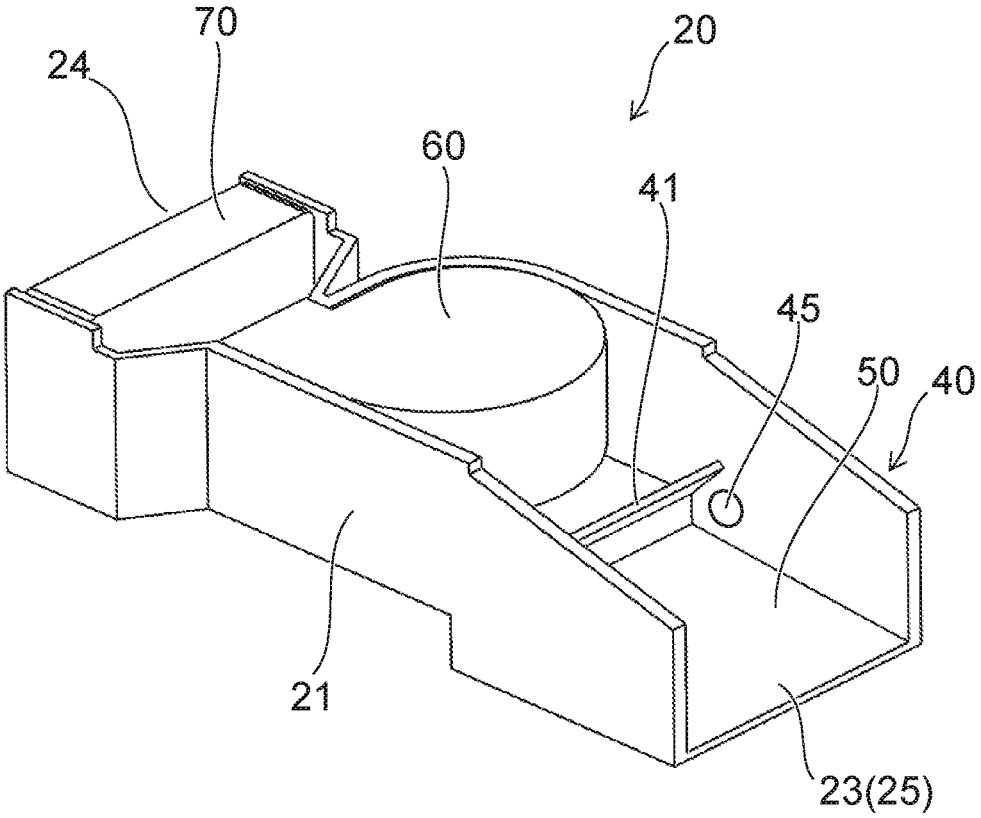
FIG. 4 is a perspective view of a state in which a cover is removed from the water deodorizing unit of FIG. 3.

FIG. 4 is a perspective view of a state in which a cover 22 is removed from the water deodorizing unit 20 of FIG. 3.

Figure 5:
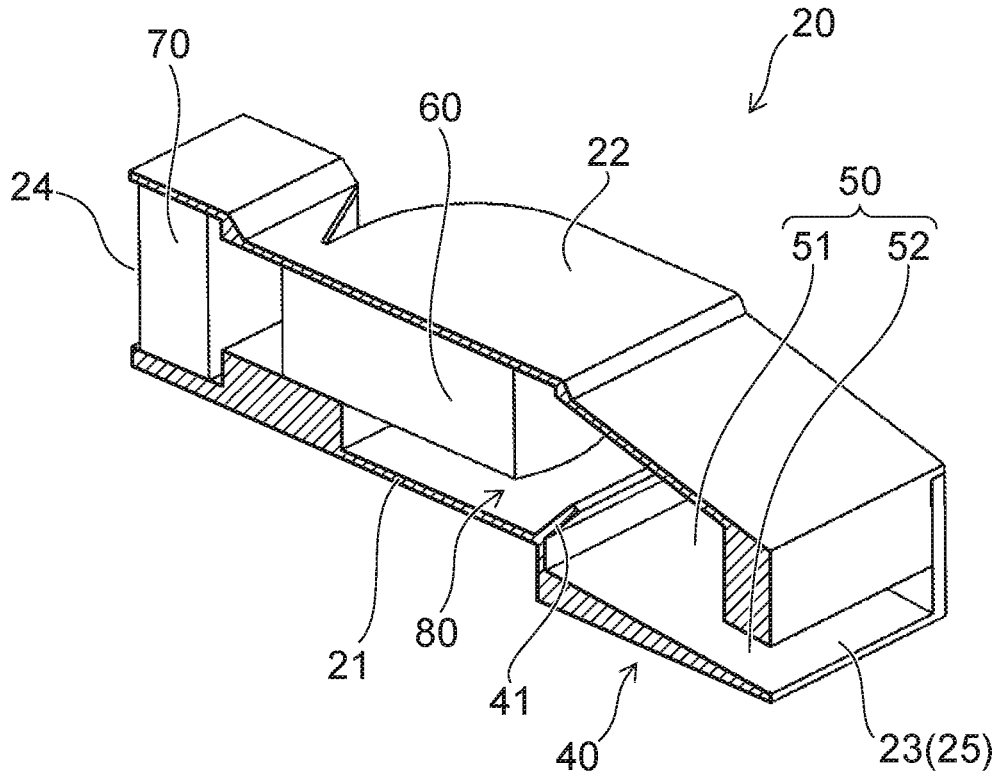
FIG. 5 is a cross-sectional perspective view of the water deodorizing unit of the flush toilet deodorizing device according to the first embodiment.

FIG. 5 is a cross-sectional perspective view of the water deodorizing unit 20.

As shown in FIG. 3 to FIG. 5, the water deodorizing unit 20 includes a case 21 and the cover 22. A water deodorizing part 40, a fan device 60, and an oxidation catalyst 70 are provided in the space between the case 21 and the cover 22.

Air is caused to flow through the space between the case 21 and the cover 22 by driving the fan device 60. An intake port part 123 is provided at one end part of an air channel (a deodorizing air channel) 80 through which the air flows; and an exhaust port part 124 is provided at the other end part of the deodorizing air channel 80. The intake port part 123 forms an intake port 23; and the exhaust port part 124 forms an exhaust port 24. The deodorizing air channel 80 links the intake port 23 and the exhaust port 24. The region of the deodorizing air channel 80 other than the intake port 23 and the exhaust port 24 is covered with the case 21 and the cover 22. The fan device 60 is a sirocco fan; for example, an axial fan or a cross-flow fan may be used.

The intake port 23 is positioned furthest upstream in the deodorizing air channel 80; and the exhaust port 24 is positioned furthest downstream in the deodorizing air channel 80. The fan device 60 is disposed downstream of the water deodorizing part 40 in the deodorizing air channel 80. The oxidation catalyst 70 is disposed downstream of the fan device 60 in the deodorizing air channel 80. The water deodorizing part 40, the fan device 60, and the oxidation catalyst 70 are arranged in order from the intake port 23 side between the intake port 23 and the exhaust port 24.

The water deodorizing part 40 includes a water collecting part 50. The water collecting part 50 includes a first space 51 and a second space 52. The first space 51 and the second space 52 communicate with each other; and the second space 52 is positioned further toward the intake port 23 than is the first space 51. The second space 52 is provided between the intake port 23 and the first space 51.

The intake port 23 is open toward the bowl part 101 in the state in which the water deodorizing unit 20 is mounted on the toilet 100 shown in FIG. 2.

Air is intaken through the intake port 23 into the first space 51 via the second space 52 by driving the fan device 60. The height of the downstream end of the second space 52 in the deodorizing air channel 80 is lower than the height of the upstream end of the first space 51 in the deodorizing air channel 80. Here, "height" refers to the height along the vertical direction between the inner surface of the case 21 and the inner surface of the cover 22. The second space 52 functions as a restricting part having a reduced air channel cross-sectional area compared to the first space 51. The first space 51 is an enlarged part having an enlarged air channel cross-sectional area compared to the second space 52.

As shown in FIG. 4, a water supply part 45 is provided in a part of the case 21 forming the sidewall of the water collecting part 50. For example, the water supply part 45 is provided at a position of the water collecting part 50 proximal to the downstream-most end of the deodorizing air channel 80. For example, water is supplied from a water supply source (a service water line) to the water supply part 45 and inflows toward the water collecting part 50 from a water supply port (not illustrated) formed in the water supply part 45; and the water collecting part 50 can collect the water. In the invention, the position where the water supply part 45 is provided is not limited to a position of the water collecting part 50 proximal to the downstream-most end of the deodorizing air channel 80; and it is sufficient for the water supply to the water collecting part 50 to be possible from the position.

The water that collected in the water collecting part 50 is drained through a drainage part. The drainage part forms a drainage port 25; in the embodiment, the intake port 23 also is used as the drainage port 25; the drainage port 25 is open toward the bowl part 101; and the water that is collected in the water collecting part 50 is drained into the bowl part 101 through the drainage port 25. The bottom surface of the water collecting part 50 forms a downward incline toward the drainage port 25.

A water-receiving barrier 41 is provided in the water collecting part 50 at the most end of the fan device 60 side. The water-receiving barrier 41 protrudes from the bottom surface of the water collecting part 50 into the deodorizing air channel 80 of the first space 51. In the deodorizing air channel 80, the upper end of the water-receiving barrier 41 is positioned upstream of the lower end of the water-receiving barrier 41. The upper end of the water-receiving barrier 41 is positioned higher than the upper surface of the second space 52; and the distance (the height) between the upper end of the water-receiving barrier 41 and the bottom surface of the water collecting part 50 is higher than the height of the second space 52. A space is formed between the cover 22 and the upper end of the water-receiving barrier 41 and permits the flow of air from the first space 51 toward the fan device 60. The water collecting part 50 has a bottom surface 151 that has a downward incline along the direction from the water-receiving barrier 41 toward the drainage port 25.

An operation of the deodorizing device 10 according to the embodiment will now be described.

Figure 6:
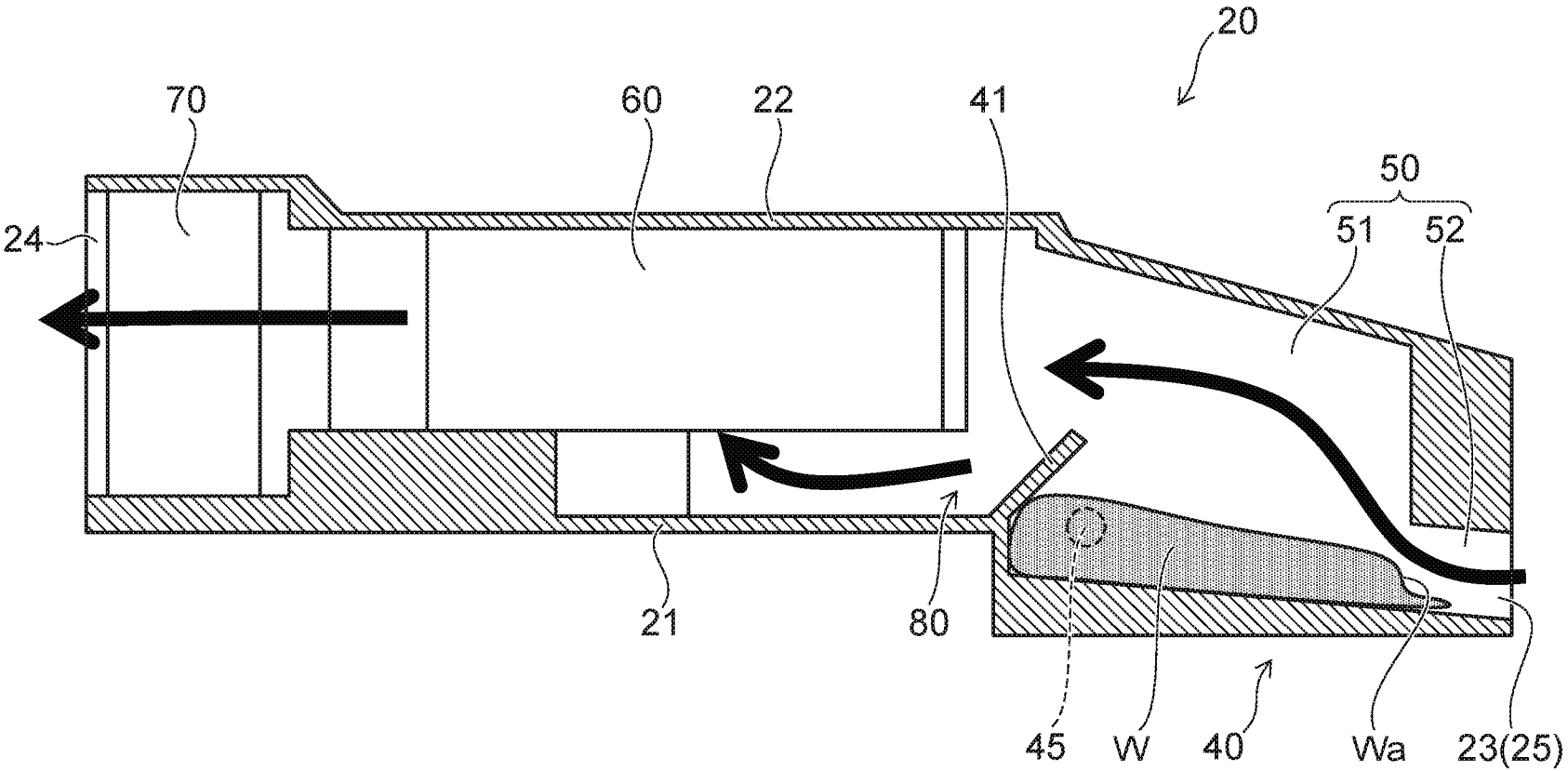
FIG. 6 is a cross-sectional view of a water collection operation in the flush toilet deodorizing device according to the first embodiment.
Figure 7:
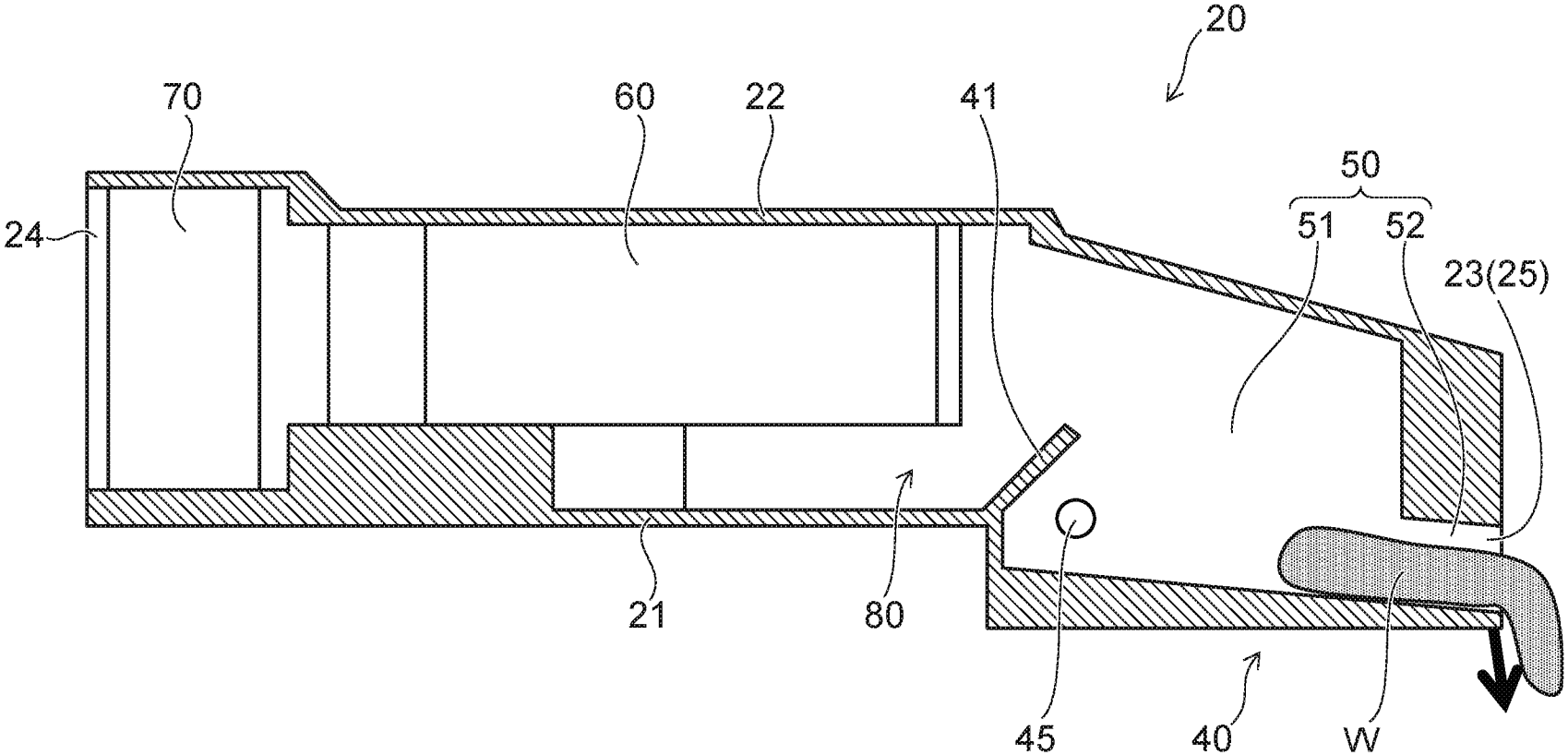
FIG. 7 is a cross-sectional view of a drainage operation of the flush toilet deodorizing device according to the first embodiment.

FIG. 6 is a cross-sectional view of the water collection operation in the deodorizing device 10. FIG. 7 is a cross-sectional view of the drainage operation of the deodorizing device 10.

When seat contact of the user on the toilet 100 is detected, the fan device 60 is driven by a control of the controller 30; and water is supplied from the water supply part 45 to the water collecting part 50 by a control of the controller 30. For example, the driving of the fan device 60 and the water supply from the water supply part 45 are started simultaneously. Or, there may be a time lag between the water supply timing and the timing of driving the fan device 60. The controller 30 controls the start and the stop of the driving of the fan device 60 and the start and the stop of the supply of the water from the water supply part 45. The seat contact of the user on the toilet 100 is detected by a sensor provided in the toilet space (e.g. in the toilet seat and/or the toilet 100). It is sufficient for the sensor to be able to detect the presence or absence of the user. For example, the sensor may detect the user's departure, the user's approach. The sensor is an infrared sensor; for example, a microwave sensor or a pressure sensor may be used. The driving of the fan device 60 and the water supply from the water supply part 45 may be started by the operation of the operation unit (e.g. a remote controller or a touch panel) by the user.

The fan device 60 that is driven by the controller 30 intakes air through the intake port 23 into the deodorizing air channel 80. In FIG. 6, the flow of the air inside the deodorizing air channel 80 is illustrated by black thick arrows. The air that is intaken through the intake port 23 flows through the second space 52 and the first space 51 of the water collecting part 50 and is suctioned into the fan device 60; and the air that is discharged from the fan device 60 passes through the oxidation catalyst 70 and is exhausted from the exhaust port 24.

Air that is at atmospheric pressure is suctioned through the intake port 23 into the deodorizing air channel 80. In other words, the fan device 60 functions as a negative pressure generation device generating a negative pressure in the deodorizing air channel 80. The bottom surface of the water collecting part 50 forms a downward incline toward the drainage port 25 (also used as the intake port 23); therefore, the water that is supplied to the water collecting part 50 by the controller 30 can flow along the bottom surface of the water collecting part 50 toward the drainage port 25. A structure that might dam the flow of the water is not provided at the bottom surface of the water collecting part 50. Therefore, the water that is supplied to the water collecting part 50 by the controller 30 can be drained as-is through the drainage port 25.

However, in the state in which the fan device 60 is driven, the water that is supplied from the water supply part 45 can be collected in the water collecting part 50 because the negative pressure generated in the water collecting part 50 pushes, onto the water, air flowing in the reverse direction of the drainage direction of the water.

After a prescribed period of time, the supply of the water from the water supply part 45 is stopped by the controller 30. For example, the magnitude of the negative pressure generated in the water collecting part 50 can be controlled by the rotational speed control of the fan device 60. According to the magnitude of the negative pressure, the total amount of the water supplied from the water supply part 45 may be held in the water collecting part 50, or some of the water supplied from the water supply part 45 may be drained through the drainage port 25 and a remaining prescribed amount of the water may be held in the water collecting part 50. It is desirable for the total amount of the water supplied from the water supply part 45 to be held in the water collecting part 50; and because this configuration can hold more water in the water collecting part 50, the deodorizing performance can be ensured further. On the other hand, because the amount of the water held in the water collecting part 50 can be controlled according to the magnitude of the negative pressure, for example, by setting the water supplied from the water supply part 45 to be not less than the amount to be collected, the water amount to be collected can be held in the water collecting part 50 more reliably while draining some of the supplied water through the drainage port 25 even when the amount of the water supplied from the water supply part 45 fluctuates.

The air that includes offensive-odor components and is intaken through the intake port 23 flows along the surface of water W collected in the water collecting part 50; and the surface of the water W collected in the water collecting part 50 forms a part of the deodorizing air channel 80. Then, the highly water-soluble offensive-odor components such as ammonia, trimethylamine, etc., that cause a urine odor are deodorized by being dissolved in the water W collected in the water collecting part 50.

The offensive-odor components such as hydrogen sulfide, methylmercaptan, etc., that cause a feces odor, are not dissolved in the water W, and are in the air flowing further downstream through the deodorizing air channel 80 are deodorized by the oxidation catalyst 70. The oxidation catalyst 70 oxidizes and decomposes hydrogen sulfide and methylmercaptan.

Thus, according to the embodiment, ammonia and trimethylamine which are highly water-soluble can be deodorized by the water deodorizing part 40; and hydrogen sulfide and methylmercaptan which do not dissolve as easily in water as do ammonia and trimethylamine can be deodorized by the oxidation catalyst 70. The deodorized air is exhausted from the exhaust port 24.

Also, fine debris such as dust, paper bits, etc., suctioned through the intake port 23 with the air can be trapped by the water W collected in the water collecting part 50; and the performance decrease of the oxidation catalyst 70 due to the fine debris flowing into the oxidation catalyst 70 can be suppressed. The fine debris that undesirably reaches the fan device 60 also can be suppressed because the fan device 60 is disposed downstream of the water collecting part 50 in the deodorizing air channel 80. Normally, a mesh filter for trapping fine debris is provided at the intake port of the deodorizing device; however, in the embodiment, the fine debris can be trapped by the water collecting part 50; and a mesh filter may not be provided. Therefore, in the embodiment, the trouble of performing maintenance of the mesh filter can be eliminated.

By using a simple configuration in which one fan device 60 is used and the water deodorizing part 40 and the oxidation catalyst 70 are disposed inside one deodorizing air channel 80, both offensive-odor components having high water solubility and offensive-odor components having lower water solubility but higher oxidative decomposition capability can be deodorized effectively. Both the deodorizing performance and the avoidance of a larger size and a higher complexity can be realized.

The water collecting part 50 includes the second space 52 that functions as a restricting part, is lower than the first space 51, and has a small air channel cross-sectional area. The air that is intaken through the intake port 23 is accelerated by the second space 52. Thereby, the surface of the water W of the water collecting part 50 forming a part of the deodorizing air channel 80 undulates easily (waves form easily); and the contact surface area between the air and the water surface can be increased. The increase of the contact surface area between the air and the water surface increases the dissolution efficiency in water of the offensive-odor components having high water solubility in air. Therefore, for example, the degradation of the deodorizing performance can be avoided while avoiding the larger size and the higher complexity of a configuration that uses a water spraying device to spray water or guides water to stored water. When the air is accelerated by the second space 52 (the restricting part), the pressure of the air pushing the water W increases; and the effect of holding the water W in the water collecting part 50 also increases.

An aromatic often is placed in the toilet space. Generally, that the oxidation catalyst may generate an offensive odor when the alcohol component (e.g., ethanol or methanol) included in the aromatic or the like adheres. Although the alcohol component can be dissolved in the water in the water deodorizing part 40, water in which the alcohol component has dissolved may splash downstream; and the water in which the alcohol component has dissolved may contact the oxidation catalyst 70. Particularly when the water deodorizing unit 20 is provided in the sanitary washing device 200, downsizing is desirable; therefore, the distance between the water deodorizing part 40 and the oxidation catalyst 70 is likely to be short.

In the embodiment, the water-receiving barrier 41 is provided as a splash suppression part suppressing the splashing toward the oxidation catalyst 70 of the water W collected in the water collecting part 50. According to such an embodiment, the water in which the alcohol component has dissolved can avoid contacting the oxidation catalyst 70 because the adhesion to the oxidation catalyst 70 of the alcohol component dissolved in the water W of the water collecting part 50 is avoided effectively; and the water-receiving barrier 41 suppresses the splashing toward the oxidation catalyst 70 of the water in which the alcohol component has dissolved.

According to the embodiment, alcohol dissolution is possible merely by storing the water W in the water collecting part 50; therefore, the configuration is simple compared to, for example, mist spraying from a nozzle, etc. The water-receiving barrier 41 also has a simple configuration; therefore, according to the embodiment, the offensive odor generation by the oxidation catalyst 70 caused by alcohol components can be avoided while avoiding a larger size and a higher complexity.

The first space 51 of the water collecting part 50 is higher than the second space 52 and has a larger volume, and is provided as an enlarged part having an enlarged air channel cross-sectional area. Such a first space 51 also can function as the splash suppression device recited above. In other words, by enlarging the air channel cross-sectional area at the first space 51, the air velocity of the air can be reduced; and the splashing of the water W downstream can be suppressed thereby. The splashing of the water toward the fan device 60 also can be suppressed; and the malfunction and the performance decrease of the fan device 60 can be avoided.

An example is shown in FIG. 6 in which the water W collects in a region extending from the water-receiving barrier 41 through the first space 51 to the second space 52. It is sufficient for the water W to collect in at least a partial region of the first space 51; and it is unnecessary for the water W to collect in the second space 52. If the water W collects in the second space 52 as well, the contact surface area between the air and the water surface can be increased, which increases the dissolution efficiency in water of the offensive-odor components having high water solubility in air.

The water W that is pushed by the air is dammed by the water-receiving barrier 41 and impeded from receding downstream in the deodorizing air channel 80. In this state, a water surface Wa that has a wall-like shape forms easily and opposes the air inflowing through the intake port 23 and flowing along the upper surface of the second space 52. The wall-like shape water surface Wa forms a boundary around which the water surface upstream of the water surface Wa in the deodorizing air channel 80 is formed at a position lower than the water surface downstream in the deodorizing air channel 80. A level difference forms between the water surface upstream of the water surface Wa and the water surface downstream of the water surface Wa. Because the air contacts the wall-like shape water surface Wa in addition to the upper surface of the water W, the dissolution efficiency in water of the highly water-soluble offensive-odor components can be increased; and the fine debris is trapped by the water W even more easily.

Because the water-receiving barrier 41 extends higher than the upper surface of the second space 52 at the intake port 23 side, the height inside the first space 51 of the water W dammed by the water-receiving barrier 41 easily becomes higher than the height inside the second space 52 of the water W dammed by the water-receiving barrier 41. This easily forms the level difference of the water surface at the vicinity of the boundary between the first space 51 and the second space 52; and the wall-like shape water surface Wa forms easily.

The user rises from the toilet 100; and the controller 30 stops the driving of the fan device 60 based on the user rising from the toilet 100. When the fan device 60 is stopped, the water collecting part 50 returns to atmospheric pressure; and the force that holds the water W in the collected state is released. Then, because the bottom surface of the water collecting part 50 has the downward incline toward the drainage port 25, the water W that collected in the water collecting part 50 is drained into the bowl part 101 of the toilet 100 (shown in FIGS. 1 and 2) through the drainage port 25 as shown in FIG. 7. The sensor that is provided in the toilet space detects the user rising from the toilet 100. The driving of the fan device 60 may be stopped by the operation of the operation unit (e.g. a remote controller or a touch panel) by the user. The driving of the fan device 60 may be automatically stopped after a predetermined period of the starting of the driving of the fan device 60 by the operation of the operation unit.

If a movable member, e.g., a solenoid valve is used as the drainage mechanism, the water may not be drained due to a valve-opening failure caused by sticking of the solenoid valve; but in the embodiment, water drainage is possible merely by stopping the formation of the negative pressure by the fan device 60 without providing such a drainage mechanism. A simple configuration can drain the water from the water collecting part 50 and reduce the water remaining in the water collecting part 50; and the formation of the biofilm caused by the remaining water can be suppressed. The fine debris that is trapped by the water W collected in the water collecting part 50, etc., also is drained with the water W.

The collection and the drainage of the water can be realized by using, as the device forming the negative pressure, the fan device that is originally necessary in the deodorizing device to intake and exhaust the air as a minimum electrical component; it is unnecessary to provide separately a pump or the like for forming the negative pressure; and a lower cost and downsizing are possible.

Because the water collecting part 50 bottom surface has a downward incline, the water is drained easily from the water collecting part 50; the water that remains in the water collecting part 50 can be reduced further; and the effect of suppressing the formation of the biofilm can be increased.

According to the embodiment described above, by the formation of the negative pressure accompanying the flow of the air, the water W collects in the water collecting part 50; the surface of the water W forms a part of the deodorizing air channel 80; and the air that includes offensive-odor components flows along the surface of the water W. Such a configuration can cause a higher amount of air to contact the water surface compared to, for example, a configuration in which the water does not collect due to the formation of a negative pressure but the air is caused to contact the surface of water prestored in a tank; and the dissolution efficiency of the offensive-odor components in water can be increased. Accordingly, the embodiment realizes both the deodorizing performance and the avoidance of a larger size and a higher complexity.

For example, the oxidation catalyst 70 has a cartridge form, is attachable and detachable, and is replaceable in the sanitary washing device 200. As shown in FIG. 2, the user can replace the oxidation catalyst 70 easily because the oxidation catalyst 70 is disposed at the outer edge part side of a casing 202 of the sanitary washing device 200.

For example, the oxidation catalyst 70 has a honeycomb structure and has the effect of suppressing the operation sound of the fan device 60. The arrangement relationship between the oxidation catalyst 70 and the fan device 60 described above reduces the noise when deodorizing compared to a configuration in which the fan device 60 is disposed further toward the outer edge part of the casing 202 than is the oxidation catalyst 70.

A deodorizing device according to a second embodiment of the invention will now be described with reference to FIGS. 8 to 14. Here, only the aspects of the second embodiment of the invention that are different from the first embodiment are described; similar parts are marked with the same reference numerals in the drawings; and a description of similar parts is omitted.

Figure 8:
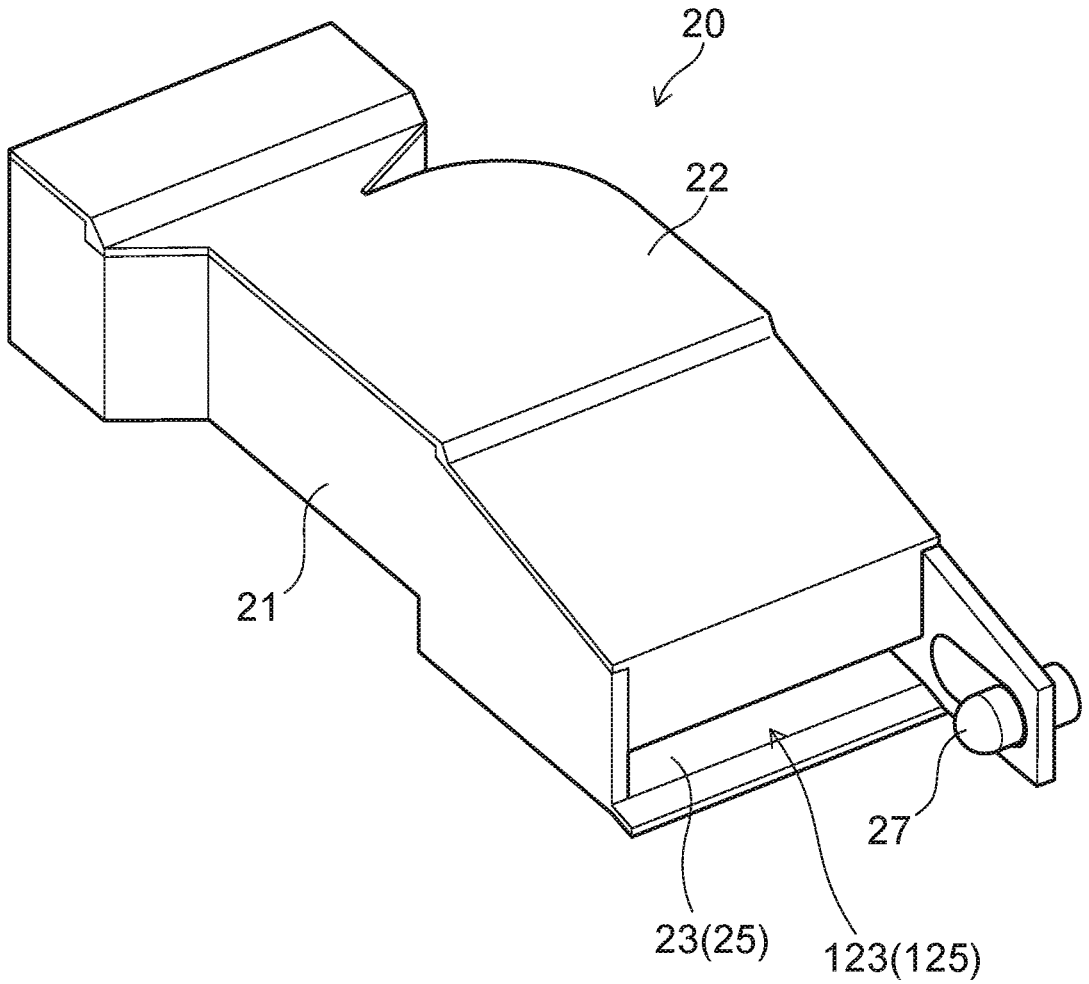
FIG. 8 is a perspective view of a water deodorizing unit according to a second embodiment.
Figure 9:
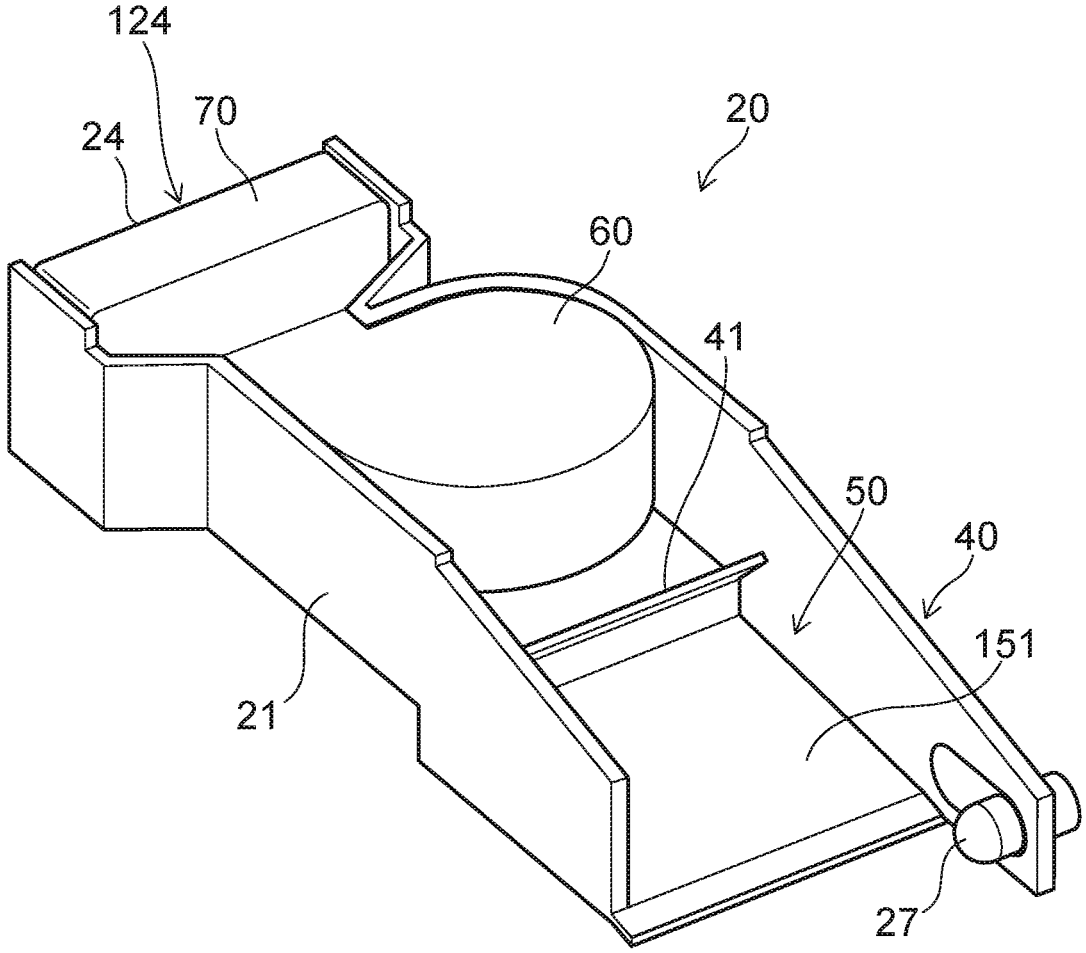
FIG. 9 is a perspective view of a state in which a cover is removed from the water deodorizing unit of FIG. 8.
Figure 10:
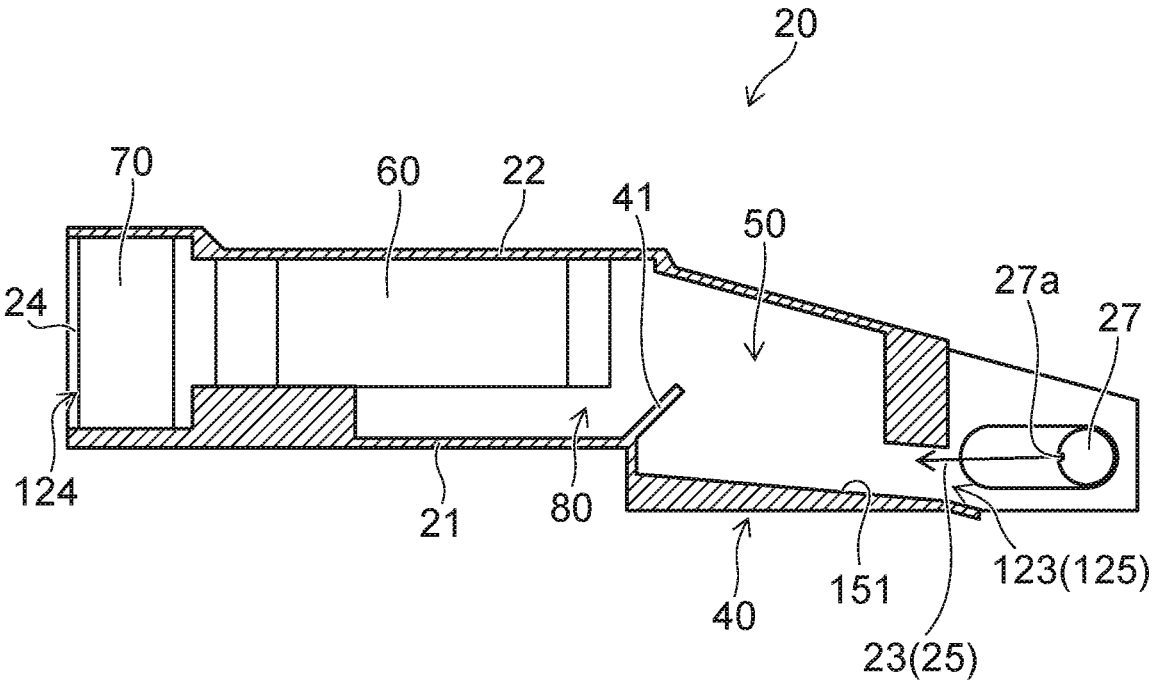
FIG. 10 is a cross-sectional view of the water deodorizing unit according to the second embodiment.
Figure 11:
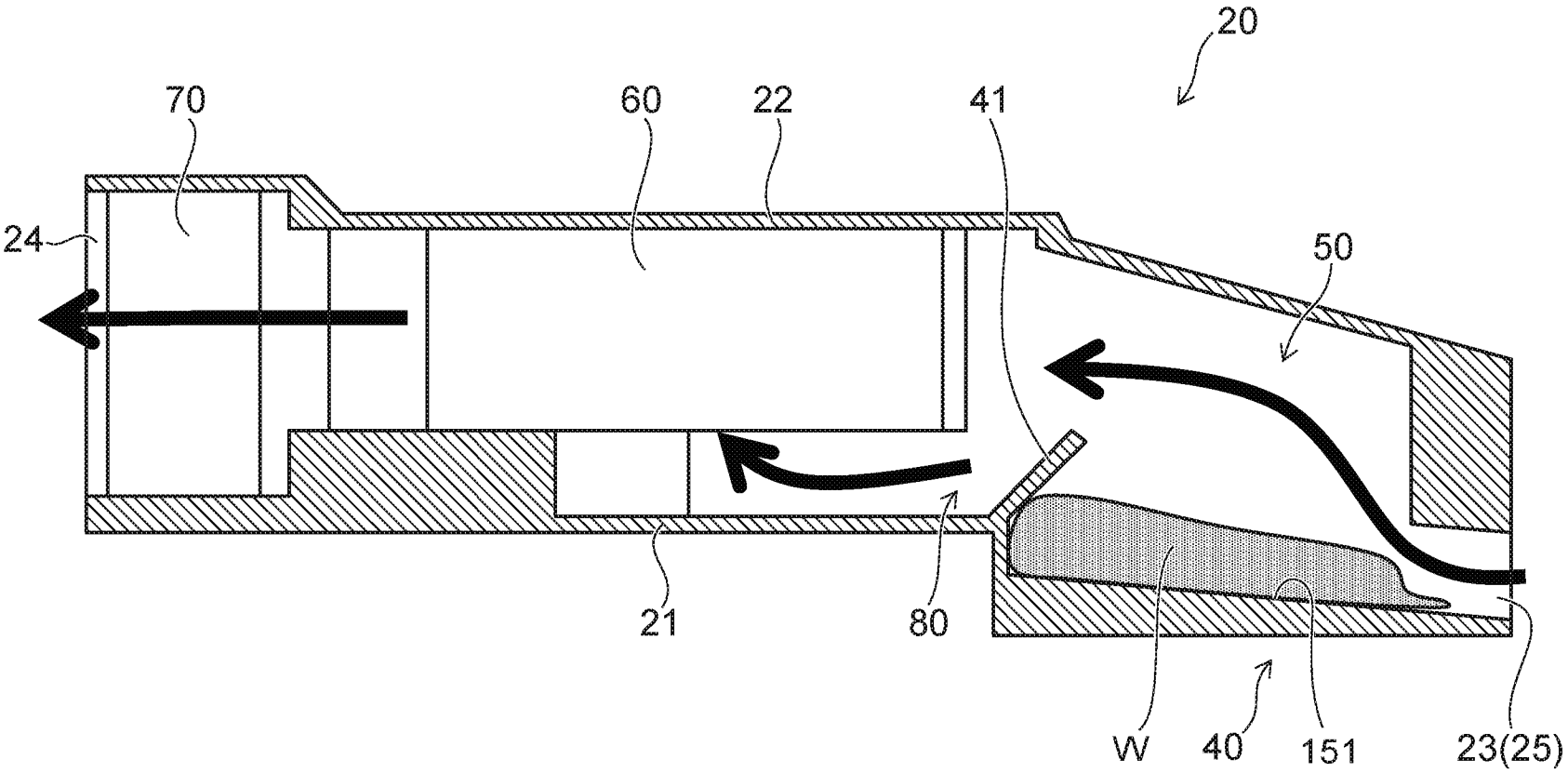
FIG. 11 is a cross-sectional view of a water collection operation in the water deodorizing unit according to the second embodiment.
Figure 12:
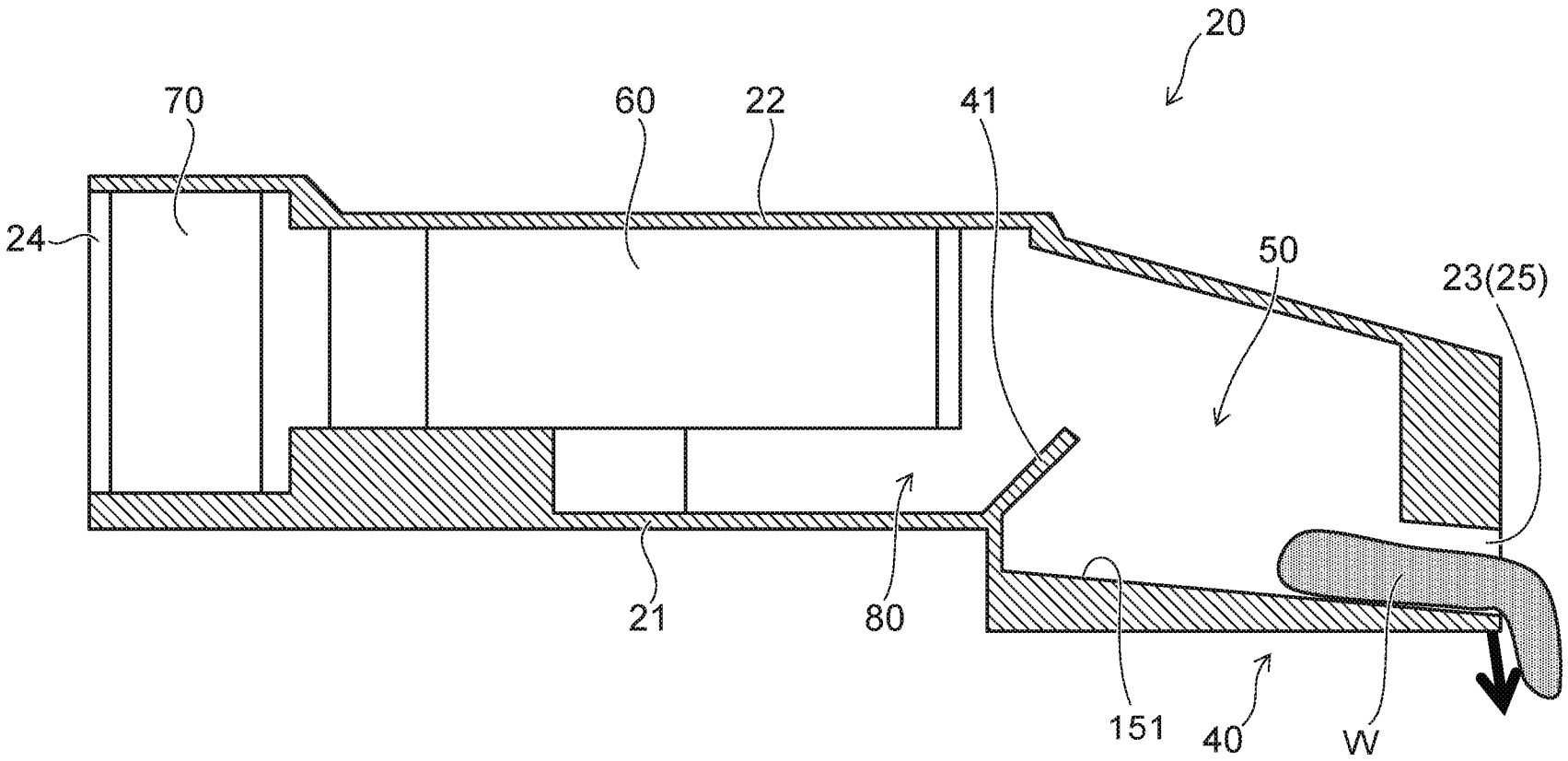
FIG. 12 is a cross-sectional view of a drainage operation of the water deodorizing unit according to the second embodiment.

The deodorizing device of the second embodiment includes the water deodorizing unit 20 and a controller 90. In the embodiment, a water supply part 27 is provided in an inner side surface of the case 21 at the vicinity of the drainage port 25. As shown in FIGS. 8 to 12, the water supply part 27 is a water supply nozzle having a water supply port 27*a*. In the state in which the water deodorizing unit 20 is mounted on the toilet 100 shown in FIG. 1, the water supply part 27 is positioned outside the water collecting part 50 and is positioned above the opening of the bowl part 101. As shown in FIG. 8, the drainage port 25 is positioned between the water collecting part 50 and the water supply part 27. The water supply part 27 is positioned with the drainage port 25 interposed at the side opposite to the water collecting part 50, and is provided at a position such that water can be supplied from the water supply part 27 to the water collecting part 50.

The controller 90 performs a first water supply mode and a second water supply mode. In the first water supply mode, the water supply part 27 supplies a first water amount to the water collecting part 50. In the second water supply mode, the water supply part 27 supplies a second water amount that is less than the first water amount to the water collecting part 50.

The controller 90 also performs a first air intake mode and a second air intake mode. In the first air intake mode, the fan device 60 intakes a first airflow rate which is the maximum airflow rate of the fan device 60. In the second air intake mode, the fan device 60 intakes a second airflow rate that is less than the first airflow rate. The rotational speed of the fan device 60 in the second air intake mode is less than the rotational speed of the fan device 60 in the first air intake mode.

The controller 90 also can cause the fan device 60 to perform a third air intake mode of intaking a third airflow rate that is less than the second airflow rate.

Figure 13:
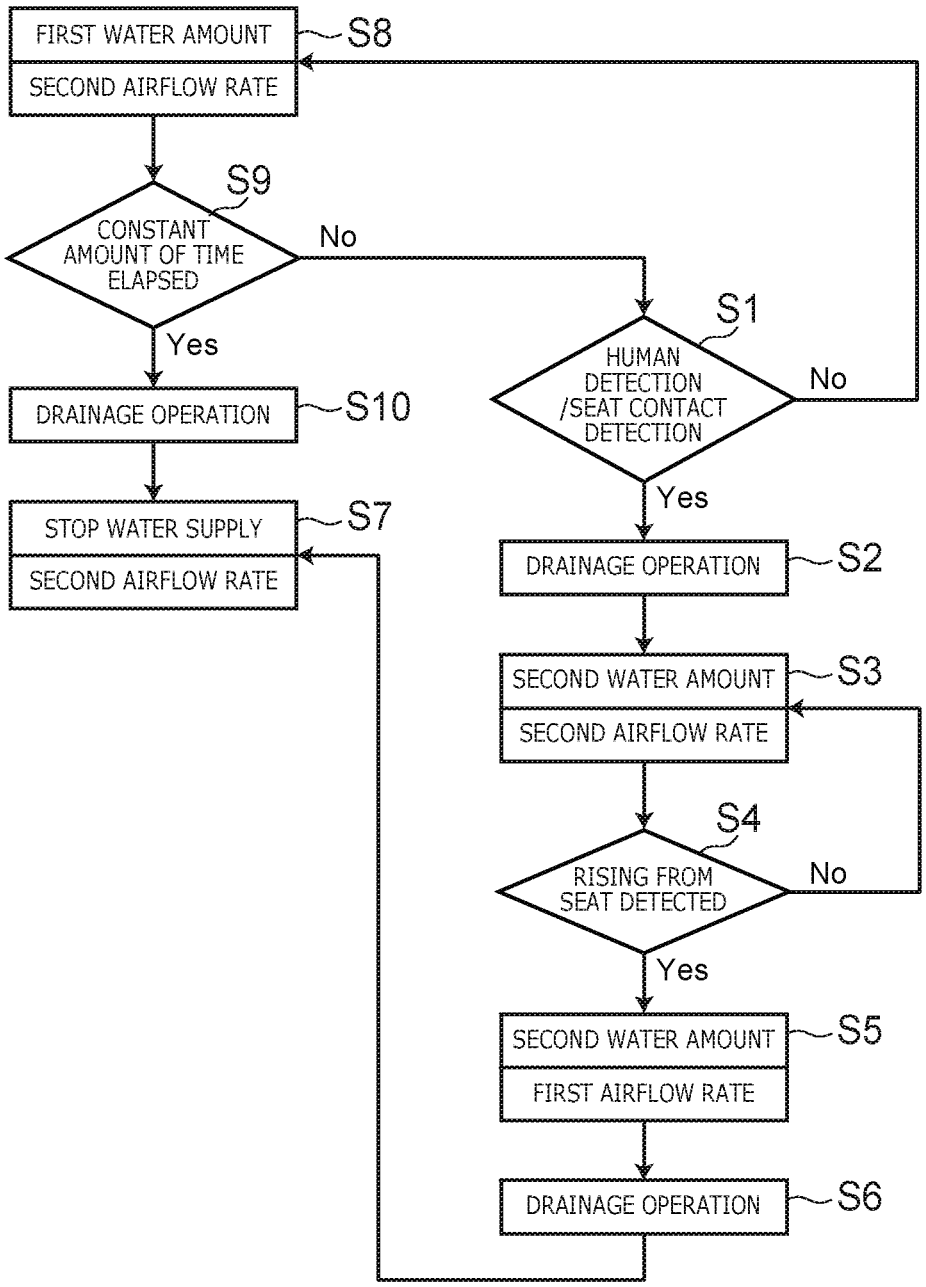
FIG. 13 is a flowchart an operational example of the toilet space deodorizing device of the second embodiment.

FIG. 13 is a flowchart a detailed operational example of the deodorizing device of the second embodiment.

For example, in a time frame in which the toilet device 1 is used often, when a human is not detected inside the toilet space or seat contact on the toilet seat is not detected in step S1, that is, when a state in which the toilet device 1 is not used is detected, the flow proceeds to step S8; and a non-use deodorizing mode is performed.

In the non-use deodorizing mode, the first water supply mode using the first water amount and the second air intake mode using the second airflow rate are performed when the toilet device 1 is not used in the time frame in which the toilet device 1 is used often. In the non-use deodorizing mode, the first water amount which is more than the second water amount is collected in the water collecting part 50; and the water deodorizing effect can be increased mainly for highly water-soluble components such as ammonia, trimethylamine, etc., adsorbed to the walls of the toilet space, etc.

When a constant amount of time has not elapsed while performing the non-use deodorizing mode in step S9 but the human detection or the seat contact detection has occurred in step S1, that is, when the use of the toilet device 1 is detected, the flow proceeds to the drainage mode of step S2.

In the drainage mode, the fan device 60 is stopped; and the resulting negative pressure release causes the water collected in the water collecting part 50 by the non-use deodorizing mode to be drained through the drainage port 25.

After the drainage operation, the flow proceeds to step S3; and the normal deodorizing mode is performed. Or, if the fan device 60 is stopped at the timing of the use of the toilet device 1 being detected in step S1 but water is not collected in the water collecting part 50, the flow proceeds to step S3 after step S1.

In the normal deodorizing mode of step S3, the second water supply mode using the water supply of the second water amount and the second air intake mode using the second airflow rate are performed.

Then, when rising from the seat is detected in step S4, the flow proceeds to step S5; and a strong deodorizing mode is performed. The second water supply mode using the water supply of the second water amount and the first air intake mode using the first airflow rate which is the maximum airflow rate are performed in the strong deodorizing mode.

In other words, in the strong deodorizing mode, the water amount that is collected in the water collecting part 50 is the second water amount which is the same as that of the normal deodorizing mode; but the airflow rate is the first airflow rate (the maximum airflow rate) which is larger than that of the normal deodorizing mode. Accordingly, the deodorizing effect of hydrogen sulfide and methylmercaptan by the oxidation catalyst 70 is higher in the strong deodorizing mode than in the normal deodorizing mode.

The normal deodorizing mode of step S3 is continued when rising from the seat is not detected, that is, in the state in which the seat contact of the user continues in step S4.

The strong deodorizing mode is performed for a prescribed period of time. After ending the strong deodorizing mode, the fan device 60 is stopped and the drainage operation from the water collecting part 50 is performed in step S6.

After the drainage operation, the drying mode is performed in step S7. In the drying mode, the water supply to the water collecting part 50 is stopped; and the fan device 60 is driven to perform the second air intake mode using the second airflow rate. The water collecting part 50 is dried by the airflow of the second air intake mode.

The non-use deodorizing mode recited above is continued if there is no human detection or seat contact detection before the constant amount of time has elapsed.

Then, when the non-use deodorizing mode has been performed the constant amount of time, the flow proceeds to step S10; the drainage mode is performed; continuing, the drying mode of step S7 is performed.

Figure 14:
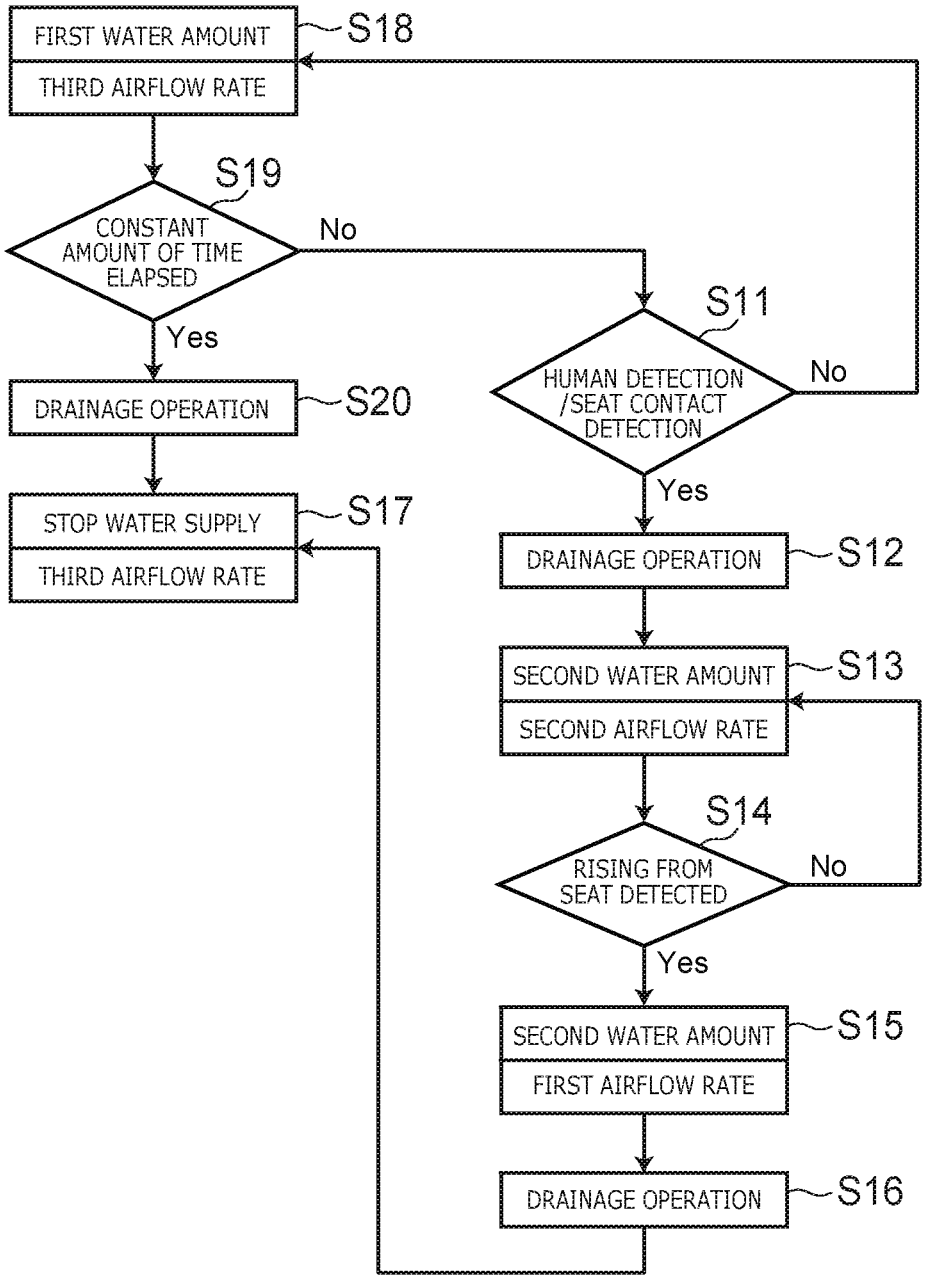
FIG. 14 is a flowchart another operational example of the toilet space deodorizing device of the second embodiment.

FIG. 14 is a flowchart of another detailed operational example of the deodorizing device of the second embodiment.

In the time frame in which the toilet device 1 is used often, when a human is not detected inside the toilet space or seat contact on the toilet seat is not detected in step S11, that is, when the state is detected in which the toilet device 1 is not used, the flow proceeds to step S18; and the non-use deodorizing mode is performed.

In the non-use deodorizing mode, when the toilet device 1 is not used in the time frame in which the toilet device 1 is used often, the first water supply mode using the first water amount and the third air intake mode using the third airflow rate which is smaller than the second airflow rate are performed.

When a constant amount of time has not elapsed while performing the non-use deodorizing mode in step S19 but the human detection or the seat contact detection has occurred in step S11, that is, when the use of the toilet device 1 is detected, the flow proceeds to the drainage mode of step S12.

In the drainage mode, the fan device 60 is stopped; and the resulting negative pressure release causes the water collected in the water collecting part 50 by the non-use deodorizing mode to be drained through the drainage port 25.

After the drainage operation, the flow proceeds to step S13; and the normal deodorizing mode is performed. Or, if the fan device 60 is stopped at the timing of the use of the toilet device 1 being detected in step S11 but water is not collected in the water collecting part 50, the flow proceeds to step S13 after step S11.

In the normal deodorizing mode of step S13, the second water supply mode using the water supply of the second water amount and the second air intake mode using the second airflow rate are performed.

Then, when rising from the seat is detected in step S14, the flow proceeds to step S15; and the strong deodorizing mode is performed. The second water supply mode using the water supply of the second water amount and the first air intake mode using the first airflow rate which is the maximum airflow rate are performed in the strong deodorizing mode.

The normal deodorizing mode of step S13 is continued when rising from the seat is not detected, that is, in the state in which the seat contact of the user continues in step S14.

The strong deodorizing mode is performed for a prescribed period of time. After ending the strong deodorizing mode, the fan device 60 is stopped and the drainage operation from the water collecting part 50 is performed in step S16.

After the drainage operation, the drying mode is performed in step S17. In the drying mode, the water supply to the water collecting part 50 is stopped; and the fan device 60 is driven to perform the third air intake mode using the third airflow rate. The water collecting part 50 is dried by the airflow of the third air intake mode.

The non-use deodorizing mode recited above is continued if there is no human detection or seat contact detection before the constant amount of time has elapsed.

Then, when the non-use deodorizing mode has been performed the constant amount of time, the flow proceeds to step S20; the drainage mode is performed; continuing, the drying mode of step S17 is performed.

According to the second embodiment described above, the water amount that is collected in the water collecting part 50 in the second water supply mode which is performed in the normal deodorizing mode and the strong deodorizing mode is less than that of the first water supply mode; therefore, the pressure loss inside the deodorizing air channel 80 can be avoided; and the degradation of the deodorizing performance of the oxidation catalyst 70 can be avoided.

On the other hand, the water amount that is collected in the water collecting part 50 in the first water supply mode which is performed in the non-use deodorizing mode is more than that of the second water supply mode; and the deodorizing effect of the offensive-odor components having high water solubility recited above increases.

Accordingly, according to the embodiment, both offensive-odor components having high water solubility and offensive-odor components having lower water solubility and higher oxidative decomposition capability can be deodorized effectively.

Although a high water amount is favorable for the deodorization of the offensive-odor components having high water solubility, increasing the water amount may cause the water to overflow from the water collecting part 50. According to the operational example shown in FIG. 7, in the first water supply mode (the non-use deodorizing mode) in which the water amount is high, the second air intake mode that has the airflow rate that is smaller than the maximum airflow rate is performed; and the first air intake mode which has the maximum airflow rate is not performed. By suppressing the airflow rate when the water amount is high, the formation of waves in the water collected in the water collecting part 50 and the suctioning of the water into the fan device 60 can be avoided. Accordingly, the overflow of the water can be avoided when the water amount is increased to increase the water deodorizing effect; on the other hand, normally or in the strong deodorizing mode, the airflow rate can be increased and the deodorizing effect of the oxidation catalyst 70 can be increased by performing the first air intake mode while suppressing the pressure loss in the second water supply mode.

In the operational example shown in FIG. 14, in the first water supply mode (the non-use deodorizing mode) in which the water amount is high, the third air intake mode that has the airflow rate that is even smaller than the second airflow rate is performed; and the first air intake mode which has the maximum airflow rate is not performed. By further suppressing the airflow rate when the water amount is high, the effect of avoiding the formation of waves in the water collected in the water collecting part 50 and the suctioning of the water into the fan device 60 can be increased further.

A biofilm may form in a configuration in which the water is collected to deodorize the offensive-odor components having high water solubility. On the other hand, according to the embodiment, the water collecting part 50 after the drainage can be dried by performing the drying mode in step S7 of FIG. 13 or step S17 of FIG. 14; and the formation of the biofilm in the water collecting part 50 can be avoided.

The modes shown in FIG. 13 and FIG. 14 described above are performed by the control of the fan device 60 and the control of the water supply part 27 by the controller 90. In other words, the controller 90 performs air intake modes having two levels or three levels of the airflow rate. Or, the controller 90 may perform air intake modes having four or more levels of airflow rates. The controller 90 performs water supply modes having two levels of the water amount. Or, the controller 90 may perform water supply modes having three or more levels of the water amount.

Although an example is described in the embodiments described above in which the deodorizing device 10 is provided in the sanitary washing device 200, it is sufficient for the deodorizing device according to the invention to be provided in a toilet space including a flush toilet; for example, the deodorizing device 10 may be provided in the toilet 100.

Hereinabove, the embodiments of the invention are described with reference to specific examples. However, the invention is not limited to such specific examples; and various modifications based on the technical spirit of the invention are possible.

Although an example is described in the embodiments described above in which the water deodorizing part includes a water collecting part configured to collect water, and the surface of the water collected in the water collecting part forms a part of the deodorizing air channel, the water deodorizing part of the invention may include, for example, a configuration in which water is sprayed into the suctioned air.

Although an example is described in the embodiments described above in which a fan device is employed as the negative pressure generation device, the invention is not limited to forming the negative pressure in the water collecting part 50 by the air suction of the fan device 60; and it is sufficient for the negative pressure generation device to be able to form a negative pressure in the water collecting part. For example, a pump may be employed as the negative pressure generation device; and a negative pressure may be formed in the water collecting part 50 by the air suction of the pump.

Although an example is described in the embodiments described above in which the intake port also is used as the drainage port, the invention is not limited to a configuration in which the intake port 23 also is used as the drainage port 25; and the intake port 23 and the drainage port 25 may be provided as separate components.

What is claimed is:

1. A flush toilet deodorizing device, comprising:

an intake port part forming an intake port intaking air;

an exhaust port part forming an exhaust port exhausting deodorized air;

a fan device provided in a deodorizing air channel, the deodorizing air channel linking the intake port and the exhaust port and allowing air to flow;

a water deodorizing part provided in the deodorizing air channel, the water deodorizing part using water to deodorize a suctioned air;

an oxidation catalyst provided in the deodorizing air channel, the oxidation catalyst provided downstream of the water deodorizing part in the deodorizing air channel; and a splash suppressor provided between the water deodorizing part and the oxidation catalyst, the splash suppressor suppressing splashing of the water of the water deodorizing part toward the oxidation catalyst by the air suctioned from the intake port, wherein the water deodorizing part includes a water collecting part configured to collect water, the splash suppressor includes a water-receiving barrier protruding into the deodorizing air channel from an inner surface of the water collecting part, an upper end of the water-receiving barrier is positioned higher than a surface of water collected in the water collecting part.

2. The flush toilet deodorizing device according to claim 1, wherein the fan device is provided downstream of the water deodorizing part in the deodorizing air channel.

3. The flush toilet deodorizing device according to claim 1, wherein a water surface of the water collected in the water collecting part forms a part of the deodorizing air channel.

4. The flush toilet deodorizing device according to claim 1, wherein the water-receiving barrier protrudes into the deodorizing air channel from a bottom surface of the water collecting part.

5. The flush toilet deodorizing device according to claim 1, wherein the splash suppressor includes an enlarged part formed at the water collecting part, the enlarged part increasing a cross-sectional area of the deodorizing air channel.

6. A flush toilet deodorizing device, comprising:

an intake port part forming an intake port intaking air;

an exhaust port part forming an exhaust port exhausting deodorized air;

a fan device provided in a deodorizing air channel, the deodorizing air channel linking the intake port and the exhaust port and allowing air to flow;

a water deodorizing part provided in the deodorizing air channel, the water deodorizing part using water to deodorize a suctioned air; and an oxidation catalyst provided in the deodorizing air channel, wherein the water deodorizing part includes a water collecting part configured to collect water, a water surface of the water collected in the water collecting part forms a part of the deodorizing air channel, the flush toilet deodorizing device further comprises:

a water supply part supplying water to the water collecting part;

a drainage part draining water from the water collecting part; and a controller controlling the water supply by the water supply part and the intake by the fan device, and the controller performs a first water supply mode of the water supply part supplying a first water amount to the water collecting part, and a second water supply mode of the water supply part supplying a second water amount to the water collecting part, the second water amount being less than the first water amount, the controller performs a first air intake mode of the fan device intaking a first airflow rate, and a second air intake mode of the fan device intaking a second airflow rate, the first airflow rate being a maximum airflow rate of the fan device, the second airflow rate being less than the first airflow rate, and the controller does not perform the first air intake mode when performing the first water supply mode, the controller performs a third air intake mode of the fan device intaking a third airflow rate, the third airflow rate being less than the second airflow rate, and the controller performs the third air intake mode when performing the first water supply mode.

7. A flush toilet deodorizing device, comprising:

an intake port part forming an intake port intaking air;

an exhaust port part forming an exhaust port exhausting deodorized air;

a fan device provided in a deodorizing air channel, the deodorizing air channel linking the intake port and the exhaust port and allowing air to flow;

a water deodorizing part provided in the deodorizing air channel, the water deodorizing part using water to deodorize a suctioned air; and an oxidation catalyst provided in the deodorizing air channel, wherein the water deodorizing part includes a water collecting part configured to collect water, a water surface of the water collected in the water collecting part forms a part of the deodorizing air channel, the flush toilet deodorizing device further comprises:

a water supply part supplying water to the water collecting part;

a drainage part draining water from the water collecting part; and a controller controlling the water supply by the water supply part and the intake by the fan device, and the controller performs a first water supply mode of the water supply part supplying a first water amount to the water collecting part, and a second water supply mode of the water supply part supplying a second water amount to the water collecting part, the second water amount being less than the first water amount, after the draining from the drainage part, the controller performs a drying mode of drying the water collecting part by driving the fan device.

* * * * *